US010480817B2

(12) United States Patent
Kashihara et al.

(10) Patent No.: US 10,480,817 B2
(45) Date of Patent: Nov. 19, 2019

(54) DUCT-TYPE INDOOR UNIT OF AIR CONDITIONER

(71) Applicant: DAIKIN INDUSTRIES, LTD., Osaka-shi, Osaka (JP)

(72) Inventors: Takashi Kashihara, Sakai (JP); Takahiro Yamasaki, Sakai (JP); Kaname Maruyama, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 355 days.

(21) Appl. No.: 14/482,565

(22) Filed: Sep. 10, 2014

(65) Prior Publication Data

US 2015/0068711 A1 Mar. 12, 2015

(30) Foreign Application Priority Data

Sep. 11, 2013 (JP) ..... 2013-188453

(51) Int. Cl.
*F24F 13/20* (2006.01)
*F24F 13/30* (2006.01)
(Continued)

(52) U.S. Cl.
CPC ..... *F24F 13/20* (2013.01); *F24F 1/0007* (2013.01); *F24F 1/0022* (2013.01);
(Continued)

(58) Field of Classification Search
CPC .. F24F 13/20; F24F 1/0007; F24F 2001/0037; F24F 1/0022; F24F 13/30;
(Continued)

(56) References Cited

U.S. PATENT DOCUMENTS 3,524,328 A * 8/1970 Schuster ..... F24F 1/02 165/122
4,507,940 A * 4/1985 Sato ..... F24D 5/04 165/122
(Continued)

FOREIGN PATENT DOCUMENTS

EP 1245908 A2 * 10/2002 ..... F24F 1/0007
EP 2602562 A1 * 6/2013 ..... F24F 1/0029
(Continued)

OTHER PUBLICATIONS

Illinois Blower, Inc. (Feb. 18, 2011). "What are the basic types of centrifugal fans and their advantages?". Retrieved Jul. 5, 2017, from http://www.illinoisblower.com/node/38.*

*Primary Examiner* — Cassey D Bauer
*Assistant Examiner* — Miguel A Diaz
(74) *Attorney, Agent, or Firm* — Birch, Stewart, Kolasch & Birch, LLP

(57) ABSTRACT

The duct-type indoor unit of an air conditioner includes: a casing including a first surface and a second surface opposing each other, an inlet duct connection part which is formed in the first surface and to which an inlet duct is connected, and an outlet duct connection part which is formed in the second surface and to which an outlet duct is connected; a partition member partitioning interior of the casing into a first space on an inlet side and a second space on an outlet side, the partitioning member having an opening communicating the first space with the second space; a heat exchanger arranged inside the first space; and a centrifugal fan having an impeller with backward curved blades, the impeller being positioned inside the second space to suck in air in the first space through the opening. The impeller has a rotating shaft parallel to the first surface.

7 Claims, 7 Drawing Sheets

(51) Int. Cl.
*F24F 13/08* (2006.01)
*F24F 1/0059* (2019.01)
*F24F 1/0007* (2019.01)
*F24F 1/0022* (2019.01)

(52) U.S. Cl.
CPC ..... *F24F 1/0059* (2013.01); *F24F 13/08* (2013.01); *F24F 13/30* (2013.01); *F24F 2013/205* (2013.01)

(58) Field of Classification Search
CPC .. F24F 2013/205; F24F 1/0014; F24F 1/0011; F24F 1/0059; F24F 2013/0616; F24F 7/007; F24F 13/08; F24F 11/0078; F24F 7/06; F24F 13/0254; F24F 7/065; F28D 1/02; F28D 1/0477; F28D 1/024; F28D 1/04; F28D 1/05366; F28D 7/0058; F28F 2250/08; F28F 2250/10
See application file for complete search history.

(56) References Cited

U.S. PATENT DOCUMENTS 4,733,543 A * 3/1988 Blair ..... F24F 1/0003 312/236
5,904,053 A * 5/1999 Polk ..... F24F 13/22 62/285
7,263,850 B2 * 9/2007 Eom ..... F24F 1/0007 62/272
9,127,867 B2 * 9/2015 Tanno ..... F24F 3/06
9,335,098 B2 * 5/2016 Pawlick ..... F28F 9/001
9,383,118 B2 * 7/2016 Wang ..... F24F 1/0022
2004/0253098 A1 * 12/2004 Hancock ..... F04D 17/02 415/206
2005/0109054 A1 * 5/2005 Eom ..... F24F 1/0007 62/286
2006/0112710 A1 * 6/2006 Terada ..... F24F 1/0007 62/285
2007/0256816 A1 * 11/2007 Higashida ..... F24F 1/0007 165/120
2010/0071868 A1 * 3/2010 Reifel ..... B23P 15/26 165/47
2010/0162739 A1 * 7/2010 Kopko ..... F24F 1/16 62/115
2011/0240262 A1 * 10/2011 Wang ..... F24F 1/0022 165/104.14
2013/0284415 A1 * 10/2013 Katoh ..... F25B 39/04 165/175
2014/0262147 A1 * 9/2014 Pawlick ..... F28F 9/001 165/67
2015/0027677 A1 * 1/2015 Taras ..... F28F 17/005 165/173
2015/0033776 A1 * 2/2015 Mercer ..... F24F 1/0007 62/89
2015/0071775 A1 * 3/2015 Kashihara ..... F24F 1/0007 415/206
2015/0121943 A1 * 5/2015 Ishino ..... F24F 13/20 62/426
2015/0168008 A1 * 6/2015 Sakoda ..... F24F 13/24 165/121
2015/0219348 A1 * 8/2015 Ikeda ..... F24F 1/0018 454/249
2016/0033182 A1 * 2/2016 Joardar ..... F25B 39/04 62/507

FOREIGN PATENT DOCUMENTS

JP 11324990 A * 11/1999
JP 2001304610 A * 10/2001
JP 2003-42480 A 2/2003
JP 2004-347311 A 12/2004
JP 2009-144996 A 7/2009
JP WO 2012165528 A1 * 12/2012 ..... F24F 1/46
JP 2013-096617 A 5/2013

* cited by examiner

DUCT-TYPE INDOOR UNIT OF AIR CONDITIONER

TECHNICAL FIELD

The present invention relates to a duct-type indoor unit of an air conditioner.

BACKGROUND ART

Duct-type indoor units of air-conditioners installed in the ceiling for air-conditioning of the interior of a building or the like have been known. Japanese Patent Application Laid-open No. 2003-42480, for example, describes a duct-type indoor unit of an air conditioner that is concealed in the ceiling. The duct-type indoor unit includes a main body casing having an inlet and an outlet arranged opposite each other, and a heat exchanger and a fan arranged along a straight line between the inlet and the outlet. An inlet duct and an outlet duct are connected to the inlet and outlet of the main body casing, respectively.

The duct-type indoor unit of the air conditioner described in Japanese Patent Application Laid-open No. 2003-42480 has respective ducts connected to the inlet side and outlet side when in use. The fluid resistance thus tends to be high at the inlet and outlet. For this reason, a sirocco fan is commonly used as the fan for achieving a high static pressure. The sirocco fan has an impeller, and a fan casing that houses this impeller.

The fan casing has a spiral shape. The fan casing has an inlet that opens in an axial direction of the impeller, and an outlet that opens at a distal end of a tubular portion extending in a centrifugal direction of the impeller. When the impeller of the sirocco fan rotates inside the fan casing, air is sucked into the fan casing from the inlet, and blown out from the outlet.

One problem with the sirocco fan used in such a duct-type indoor unit of an air conditioner is that it has a large number of components because of the fan casing.

Another problem with the sirocco fan is that it is difficult to improve the fan efficiency without the fan casing, because of the structure wherein air is blown out after first being sucked into the fan casing. This leads to yet another problem that it is difficult to reduce operating power of the fan while securing a necessary level of static pressure and flow amount.

SUMMARY OF INVENTION

An object of the present invention is to provide a duct-type indoor unit of an air conditioner with a reduced number of components and improved fan efficiency.

The duct-type indoor unit of an air conditioner according to one aspect of the present invention includes: a casing including a first surface and a second surface opposing each other, an inlet duct connection part which is formed in the first surface and defines outer edges of an inlet and to which an inlet duct is connected, and an outlet duct connection part which is formed in the second surface and defines outer edges of an outlet, and to which an outlet duct is connected; a partition member partitioning interior of the casing into a first space on an inlet side and a second space on an outlet side, the partitioning member having an opening that communicates the first space with the second space; a heat exchanger arranged inside the first space; and a centrifugal fan having an impeller with a plurality of backward curved blades, the impeller being positioned inside the second space to suck in air in the first space through the opening, wherein the impeller has a rotating shaft parallel to the first surface.

DESCRIPTION OF EMBODIMENTS

Figure 1:
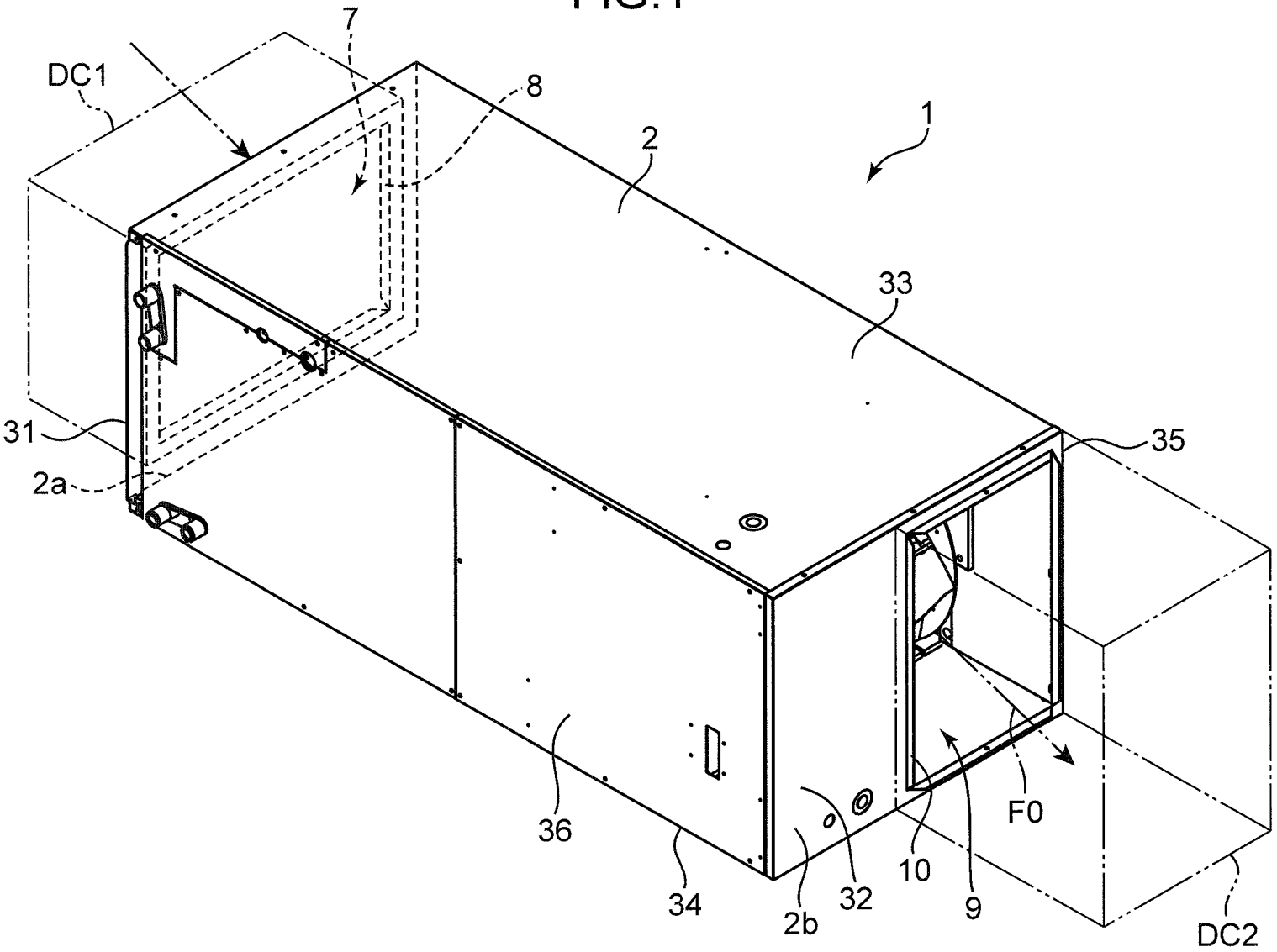
FIG. 1 is a perspective view illustrating the outer appearance of a duct-type indoor unit of an air conditioner according to one embodiment of the present invention.

Hereinafter, a duct-type indoor unit of an air conditioner according to one embodiment of the present invention will be described with reference to the drawings.

The duct-type indoor unit 1 of an air conditioner shown in FIG. 1 to FIG. 4 includes a casing 2, a partition member 3 that divides the interior of the casing 2 into two spaces (i.e., first space 11 and second space 12), a pair of heat exchangers 4 housed in the first space 11 (more specifically, in a heat exchange chamber 15 thereof), and a centrifugal fan 5 and a fan motor 6 housed in the second space 12. The fan motor 6 drives the impeller 21 of the centrifugal fan 5 to rotate.

The casing 2 includes a front plate 31, a rear plate 32, an upper plate 33, a lower plate 34, a first side plate 35, and a second side plate 36. These plates 31 to 36 constitute the elongated rectangular parallelepiped casing 2. The front plate 31 and the rear plate 32 are spaced apart from each other in a longitudinal direction of the casing 2. The upper plate 33 and the lower plate 34 are spaced apart from each other in an up and down direction orthogonal to the longitudinal direction of the casing 2 (direction of arrow Z in FIG. 2 and FIG. 4). The first side plate 35 and the second side plate 36 are spaced apart from each other in a width direction of the casing 2, with the width direction being orthogonal to the longitudinal direction and the up and down direction of the casing 2.

The casing 2 includes a first surface and a second surface, which are a pair of surfaces formed by the front plate 31 and the rear plate 32 opposite each other in a front to back direction, namely, an upstream side face 2*a* and a downstream side face 2*b*, an inlet duct connection part 8, and an outlet duct connection part 10. The upstream side face 2*a* as the first surface includes an inlet 7. The inlet duct connection part 8 is formed in the upstream side face 2*a*. The inlet duct connection part 8 defines outer edges of the inlet 7, where an inlet duct DC1 is connected. The downstream side face 2*b* as the second surface includes an outlet 9. The outlet duct connection part 10 is formed in the downstream side face 2*b*. The outlet duct connection part 10 defines outer edges of the outlet 9, where an outlet duct DC2 is connected.

Figure 2:
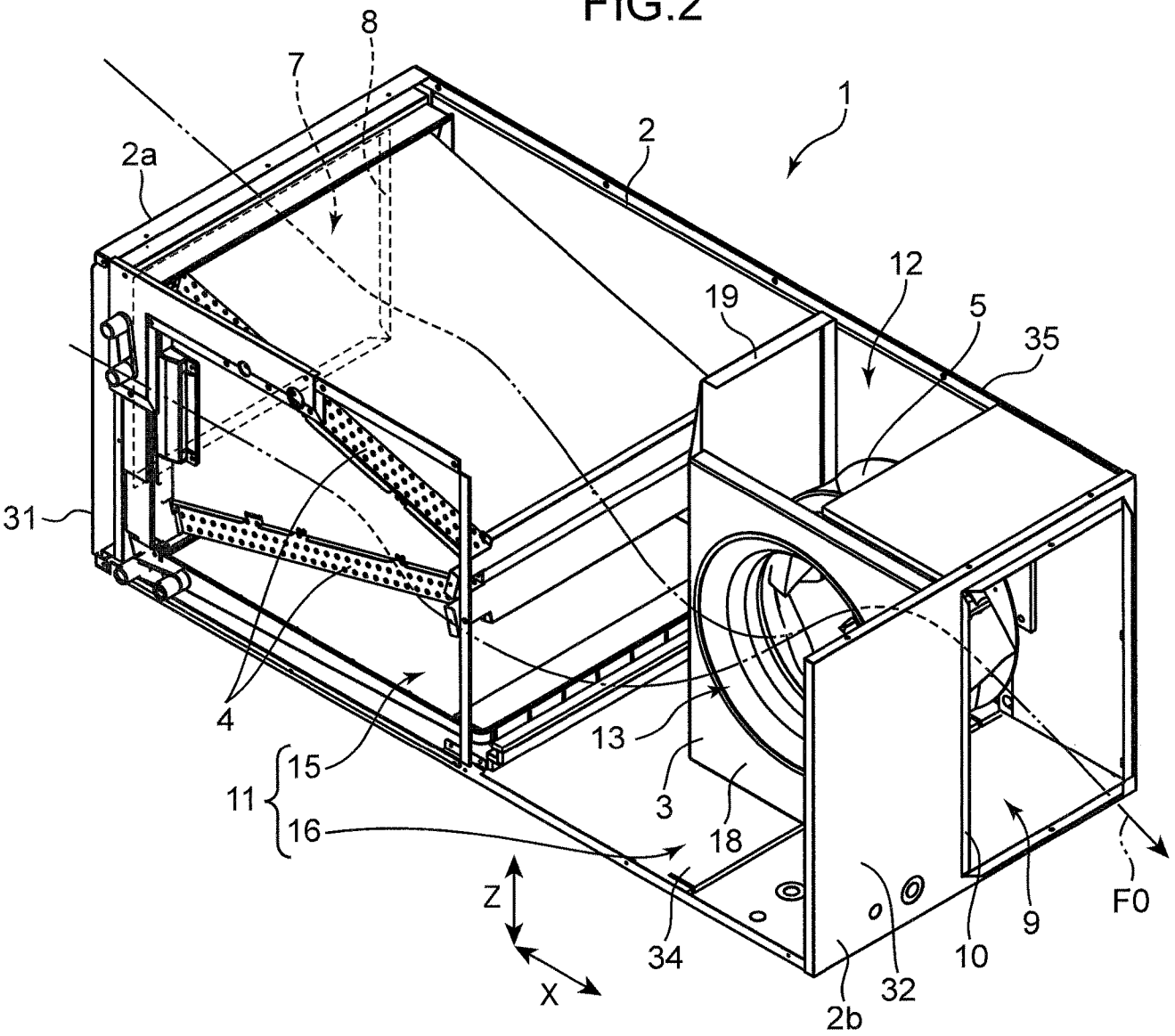
FIG. 2 is a cutaway perspective view illustrating the internal structure of the duct-type indoor unit of FIG. 1.

The outlet duct connection part 10 shown in FIG. 1 and FIG. 2, for example, includes a plurality of elongated protrusions surrounding the outlet 9 and protruding from the downstream side face 2*b* to a downstream side of an air flow F0. The outlet duct DC2 is fitted to overlap these elongated protrusions and fastened thereto with screws or the like. The inlet duct connection part 8 has a similar configuration as that of the outlet duct connection part 10.

The inlet duct DC1 and the outlet duct DC2 shall not be limited to a particular type in the present invention and may be any duct member that can be connectable to the inlet 7 and outlet 9, respectively, such as a square duct or other various shapes of duct members. The structure of the inlet duct connection part 8 and outlet duct connection part 10 is not limited to a particular one in the present invention, as long as they each have a structure that allows for connection of the inlet duct DC1 and outlet duct DC2, respectively.

The partition member 3 divides the interior of the casing 2 into the first space 11 on the inlet 7 side and the second space 12 on the outlet 9 side. The inlet 7 opens to the first space 11. The outlet 9 opens to the second space 12.

The partition member 3, more specifically, includes a first part 18 and a second part 19 continuous with this first part 18, as shown in FIG. 3 to FIG. 6.

The first part 18 is a flat plate-like part. The first part 18 extends in a direction orthogonal to the rotating shaft 27 of the impeller 21 to be described later and orthogonal to the upstream side face 2*a*. Namely, the first part 18 extends parallel to the longitudinal direction X of the casing 2. The first part 18 divides the second space 12 from an air communication space 16 to be described later in the first space 11. An opening 13 is formed in the first part 18 to communicate the second space 12 with the air communication space 16. Namely, the first space 11 communicates with the second space 12 via this opening 13.

The second part 19 that is continuous with the first part 18 is a part that divides the second space 12 from a place where the heat exchangers 4 are located (heat exchange chamber 15 to be described later) in the first space 11. More specifically, the second part 19 includes a parallel part 19*a* extending parallel to the axial direction A of the rotating shaft 27 and an inclined part 19*b* inclined from the axial direction A of the rotating shaft 27 toward the opening 13 of the first part 18. The inclination angle θ (see FIG. 3) of the inclined part 19*b* relative to the axial direction A is set such that air inside the heat exchange chamber 15 is guided smoothly to the opening 13. Thus creation of a turbulence near the inclined part 19*b* can be prevented.

The amount of protrusion of the inclined part 19*b* into the heat exchange chamber 15 can be limited by the provision of the parallel part 19*a*. This enables a certain space for the heat exchange chamber 15 to be secured. Moreover, air blown out from the centrifugal fan 5 housed in the second space 12 can be guided toward the outlet 9. The parallel part 19*a* may be omitted.

Figure 5:
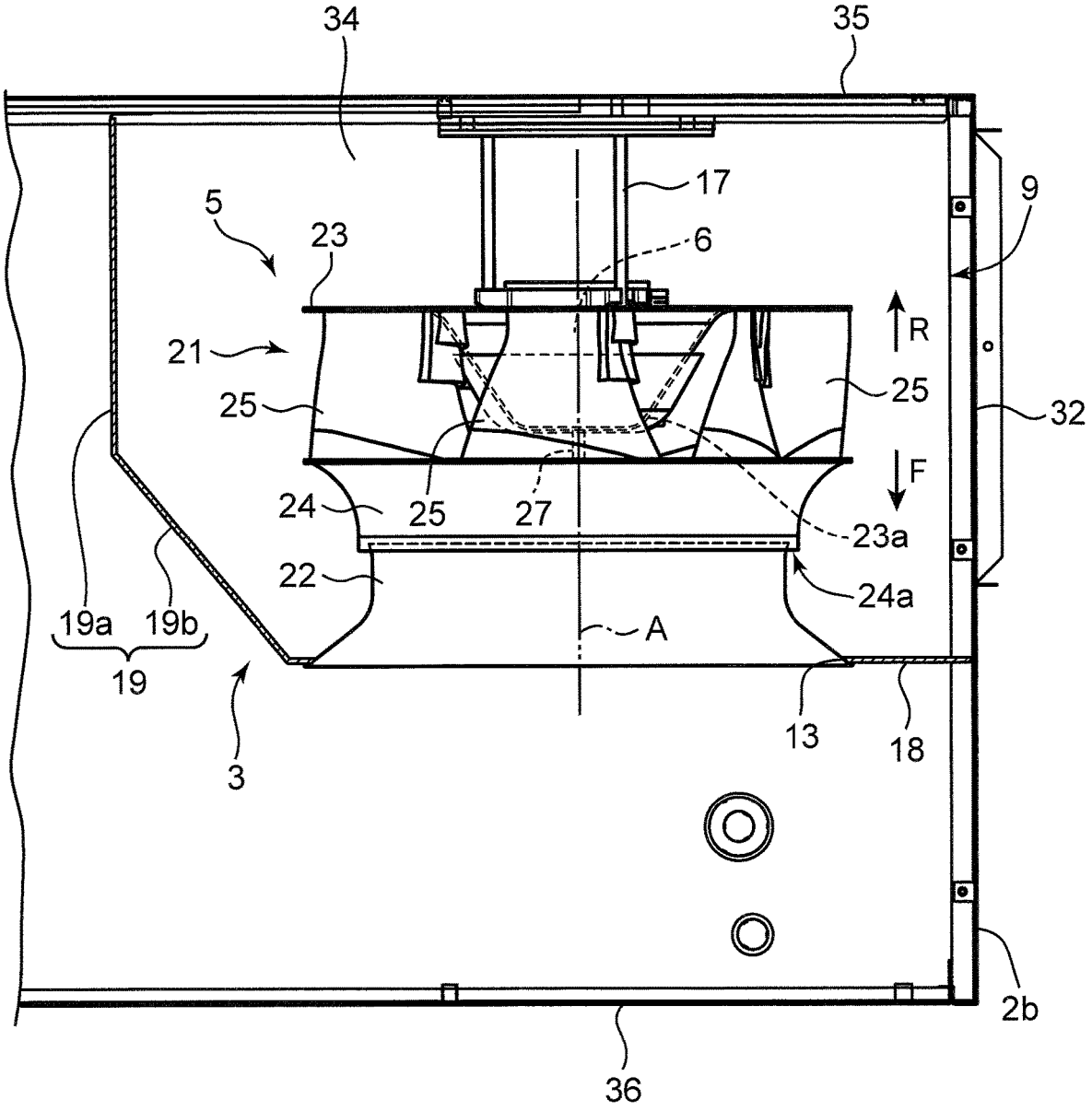
FIG. 5 is an enlarged view of a partition member of FIG. 3 and the interior of a second space.

The partition member 3 is connected to the inner walls of the casing 2 at either end as shown in FIG. 5. Namely, the parallel part 19*a* of the second part 19 of the partition member 3 is connected to the first side plate 35, while the first part 18 of the partition member 3 is connected to the rear plate 32.

The first space 11 includes the heat exchange chamber 15 that houses the heat exchangers 4, and the air communication space 16 downstream of the heat exchange chamber 15. The air communication space 16 is formed between the first part 18 and an inner face of the second side plate 36 of the casing 2 opposite the first part 18. The inner face of the second side plate 36 functions as a third surface opposite the first part. The air communication space 16 is a space extending parallel to the first part 18, and guides the air that has passed through the heat exchangers 4 housed in the heat exchange chamber 15 toward the opening 13.

Figure 3:
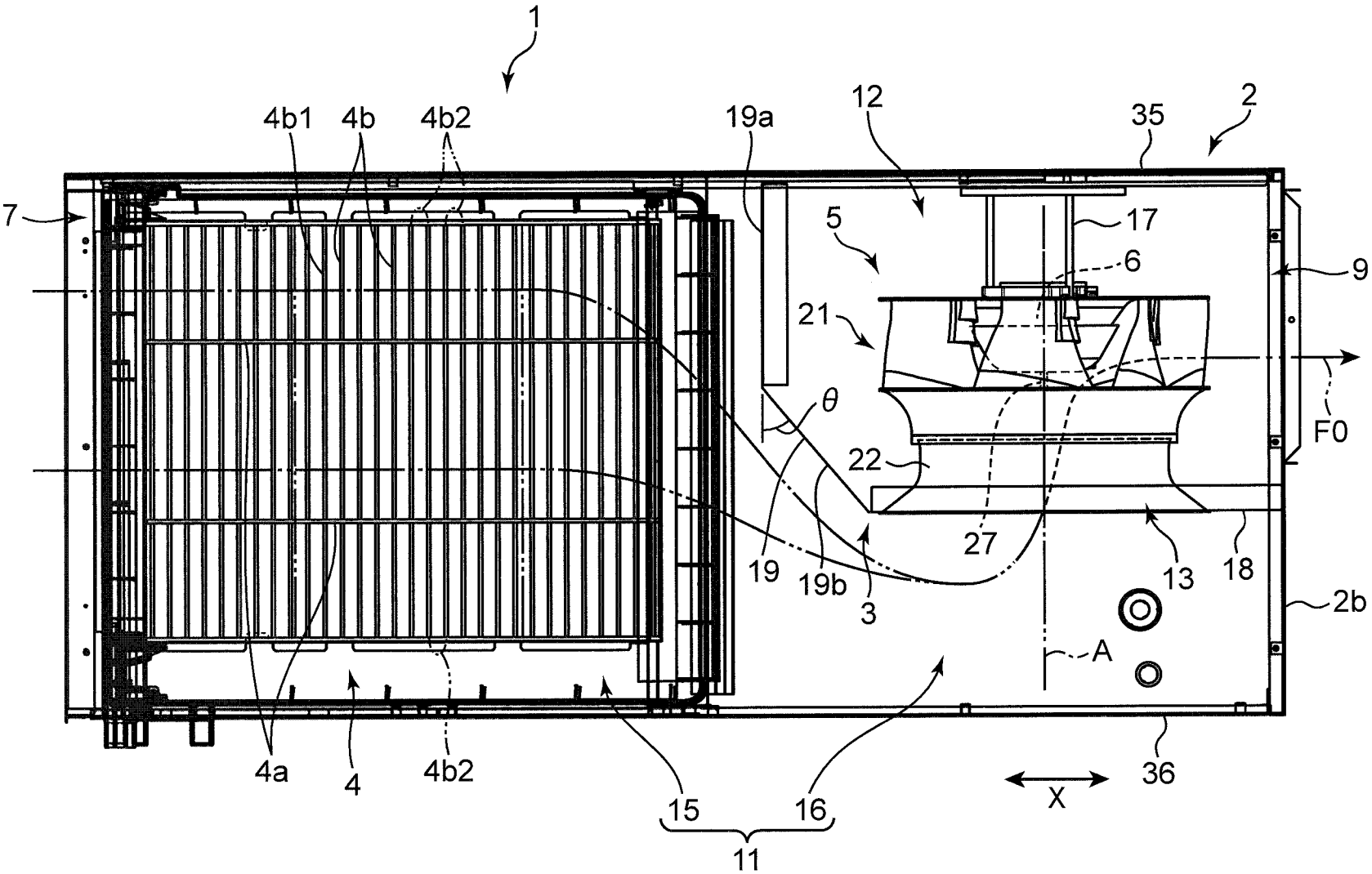
FIG. 3 is a top plan view of the duct-type indoor unit of FIG. 2.

The centrifugal fan 5 is housed in the second space 12 horizontally so that the rotating shaft 27 of the impeller 21 to be described later is parallel to both the upstream side face 2*a* and the downstream side face 2*b* as shown in FIG. 3 and FIG. 5. With such a centrifugal fan 5 of a horizontal arrangement, the outlet 9 of the casing 2 is located on the radially outer side of the impeller 21. The fan motor 6 is housed in the second space 12 horizontally so that it is coaxial with the centrifugal fan 5. The fan motor 6 is secured to the first side plate 35 of the casing 2 via a support base 17.

The centrifugal fan 5 is a turbo fan, and includes the impeller 21 and a bell mouth 22. The centrifugal fan 5 is located inside the second space 12 and sucks in air in the first space 11 through the opening 13.

Figure 6:
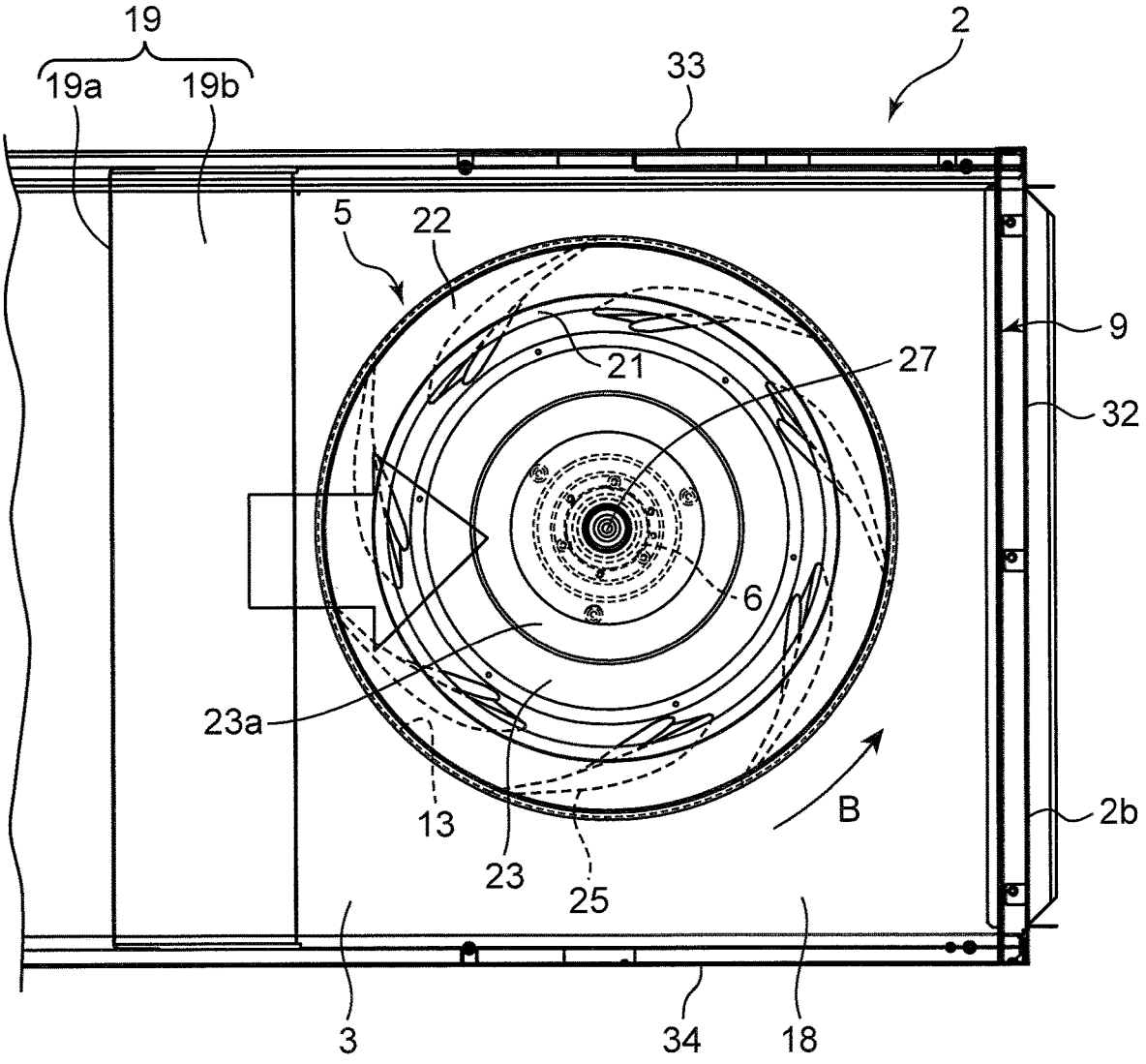
FIG. 6 is an enlarged view of a partition member of FIG. 4 and a centrifugal fan.

As shown in FIG. 5 and FIG. 6, the impeller 21 includes a hub 23, a shroud 24, and a large number of blades 25 arranged between these hub 23 and shroud 24. The hub 23 includes a protruded part 23*a* protruding toward the shroud 24 in the center of the hub 23. The protruded part 23*a* is secured to the rotating shaft 27 of the fan motor 6. The rotating shaft 27 functions as the rotating shaft of the impeller 21.

The shroud 24 is arranged opposite to the hub 23 on the front side F in the axial direction A of the rotating shaft 27. The shroud 24 includes an air inlet 24*a* that opens in the form of a circle around the rotating shaft 27. The outer diameter of the shroud 24 increases toward the rear side R.

The multiplicity of blades 25 are aligned and spaced apart a certain distance along the circumferential direction of the rotating shaft 27 between the hub 23 and the shroud 24. One end on the front side F of each blade 25 is joined to the inner face of the shroud 24. One end on the rear side R of each blade 25 is joined to the hub 23. The blades 25 are backward curved blades (backward oriented blades) that are inclined opposite to the rotating direction B (see FIG. 6) relative to the radial direction of the hub 23 (backward).

The bell mouth 22 is arranged opposite the shroud 24 on the front side F in the axial direction A. One end on the front side F of the bell mouth 22 is arranged to match in position with the edge of the opening 13 in the first part 18 of the partition member 3. The bell mouth 22 has a curved shape with its outer diameter decreasing toward the rear side R.

The centrifugal fan 5 is housed in the second space 12 of the casing 2. Thereby, air blown out from the impeller 21 is guided toward the outlet 9 by the members surrounding the impeller 21 on the radially outer side, i.e., the second part 19 of the partition member 3, and the upper plate 33, lower plate 34, and first side plate 35 of the casing 2. In other words, the second part 19 of the partition member 3, and the upper plate 33, lower plate 34, and first side plate 35 of the casing 2 function as the fan casing of the centrifugal fan 5. Therefore, it is not necessary to provide a fan casing additionally for the centrifugal fan 5 itself.

Figure 4:
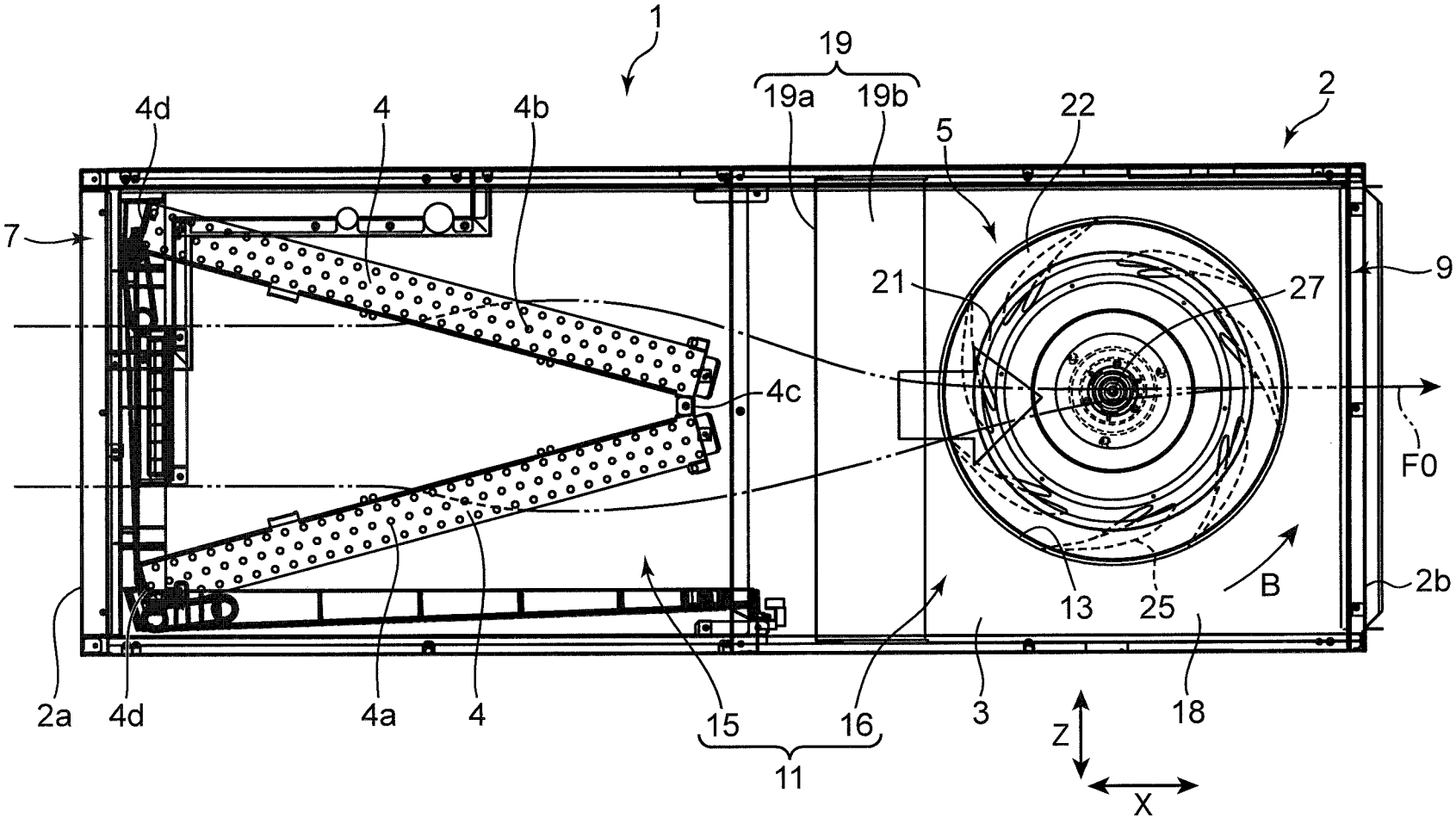
FIG. 4 is a front view of the duct-type indoor unit of FIG. 2.

The pair of heat exchangers 4 are arranged to separate from each other gradually in the up and down direction Z (i.e., vertical direction) of the casing 2 so as to have a V-shaped cross section open toward the inlet 7 of the casing 2 inside the heat exchange chamber 15 in the first space 11 of the casing 2, as shown in FIG. 4.

Moreover, as shown in FIG. 4, the pair of heat exchangers 4 are arranged such that the direction in which an edge 4*c* at the top of the V-shape formed by the heat exchangers 4 extends is parallel to the rotating shaft 27 of the impeller 21. The edges 4*d* on the side of the upstream side face 2*a* of the pair of heat exchangers 4 are also arranged parallel to the rotating shaft 27. The edges 4*d* extend along the edges of the inlet 7 of the casing 2. These edges 4*c* and 4*d* of the heat exchangers 4 all extend in a direction orthogonal to the first part 18 of the partition member 3.

More specifically, each heat exchanger 4 includes a large number of fins 4*a* spaced apart from each other, and a plurality of heat conducting tubes 4*b* extending through these fins 4*a*, as shown in FIG. 3 and FIG. 4. The heat conducting tubes 4*b* include a plurality of linearly extending straight tubes 4*b*1, and U-shaped tubes 4*b*2 that are end connection parts for connecting the ends of adjacent straight tubes 4*b*1. FIG. 3 shows a reduced number of fins 4*a* to make the heat conducting tubes 4*b* readily visible.

Each straight tube 4*b*1 extends substantially over the entire width of the heat exchange chamber 15 (i.e., substantially the entire area between the first side plate 35 and second side plate 36 of the casing 2) along a plane parallel to the plane containing the rotating shaft 27. More specifically, the straight tubes 4*b*1 of respective heat conducting tubes 4*b* are parallel to the axial direction A of the rotating shaft 27, and parallel to each other. The ends of adjacent heat conducting tubes 4*b* are connected to each other via the U-shaped tubes 4*b*2. Inside each heat exchanger 4 are formed a plurality of flow paths (refrigerant flow passages). Each path extends substantially over the entire width of the heat exchange chamber 15 (i.e., substantially the entire area between the first side plate 35 and second side plate 36 of the casing 2). The fins 4*a* are spaced apart from each other and joined to the straight tubes 4*b*1 of the heat conducting tubes 4*b* by brazing or the like. Heat exchange occurs between a refrigerant passing through the heat conducting tubes 4*b* and air around the fins 4*a* in the heat exchangers 4.

The duct-type indoor unit 1 configured as described above has the inlet duct DC1 connected to the inlet duct connection part 8, and an outlet duct DC2 connected to the outlet duct connection part 10 of the casing 2, as shown in FIG. 1. In this state, the fan motor 6 drives the impeller 21 of the centrifugal fan 5 to rotate. Thereby, an air flow F0 is created, which flows through the duct-type indoor unit 1 from the inlet duct DC1 to the outlet duct DC2, as shown in FIG. 2 to FIG. 4.

Air flows through a following path inside the casing 2 of the duct-type indoor unit 1. First, air sucked into the casing 2 from the inlet duct DC1 through the inlet 7 passes through the heat exchangers 4 in the heat exchange chamber 15 of the first space 11, where heat is exchanged between the air and the refrigerant as the air flows therethrough, to be cooled or heated. The air after the heat exchange is collected in the air communication space 16 of the first space 11 once and adjusted to flow along the longitudinal direction X of the casing 2. Part of the air after the heat exchange is guided into the air communication space 16 as it flows from the heat exchange chamber 15 thereto by the inclined part 19*b* of the second part 19 of the partition member 3.

After that, the air that has reached the air communication space 16 is introduced into the second space 12 through the opening 13 in the first part 18 of the partition member 3. In the second space 12, air flows through inside the bell mouth 22 of the centrifugal fan 5 toward the impeller 21. Air that has reached the impeller 21 is blown out to the radially outer side of the impeller 21. Air blown out from the impeller 21 smoothly flows from the casing 2 into the outlet duct DC2 through the outlet 9 located radially on the outer side of the impeller 21.

As described above, the duct-type indoor unit 1 of this embodiment employs a centrifugal fan 5 so that it does not require a fan casing as the sirocco fan does, which has been used in the duct-type indoor unit of conventional air conditioners, and therefore the number of components is reduced and the installation space of the fan is made smaller. Since the centrifugal fan 5 provides better fan efficiency than the sirocco fan, the operating power of the fan can be reduced while a necessary level of static pressure and flow amount are secured.

In the duct-type indoor unit 1, the inlet duct connection part 8 and the outlet duct connection part 10 are arranged in the upstream side face 2*a* and the downstream side face 2*b* opposite each other of the casing 2, so that the inlet duct DC1 and the outlet duct DC2 can be arranged linearly.

Since the rotating shaft 27 of the impeller 21 is parallel to the upstream side face 2*a* in which the inlet duct connection part 8 is formed, it is easy to form a flow passage for air sucked in from the inlet 7 formed in the upstream side face 2*a* to flow toward the opening 13.

In the duct-type indoor unit 1 of this embodiment, the straight tubes 4*b*1 of the heat conducting tubes 4*b* in the heat exchangers 4 extend along a plane parallel to the plane containing the rotating shaft 27, so that air introduced into the casing 2 from the inlet 7 formed in the upstream side face 2*a* parallel to the rotating shaft 27 can contact the straight tubes 4*b*1 of all the heat conducting tubes 4*b* as it flows through the heat exchangers 4. Thus the plurality of heat conducting tubes 4*b* can reliably be cooled by air. Therefore, even if the refrigerant flows through different paths in the plurality of heat conducting tubes 4*b*, there is hardly any difference in the cooling performance of the refrigerant between the different flow paths. Put differently, with the partition member 3 extending orthogonally to the rotating shaft 27 and having the first part 18 with the opening 13 as in this embodiment, there may be an uneven distribution of the flow velocity of the air flow F0 passing through the heat exchangers 4 arranged in the heat exchange chamber 15 shown in FIG. 3. More specifically, the air flows at a higher velocity near the second side plate 36 of the casing 2 opposite the opening 13 in the first part 18, as it can smoothly reach the opening 13 without being interfered with by the second part 19 of the partition member 3 (i.e., part that closes the space between the first part 18 of the partition member 3 and the first side plate 35 of the casing 2). On the other hand, the air flows at a lower velocity near the first side plate 35 opposite the second side plate 36, since it is interfered with by the second part 19. Even so, since the straight tubes 4*b*1 of the heat conducting tubes 4*b* are positioned parallel to the rotating shaft 27 as described above, all the flow paths pass through (cover) the highest velocity range of the flow velocity distribution (i.e., the range of air flowing close to the second side plate 36). Accordingly, there is hardly any difference in the cooling performance of the refrigerant between the different flow paths.

In the duct-type indoor unit 1 of this embodiment, the air communication space 16 is formed between the first part 18 of the partition member 3 extending orthogonally to the rotating shaft 27 and the inner face of the second side plate 36 of the casing 2 opposite the first part 18. Therefore, the air communication space 16 can be formed as a large space. This in turn allows the air communication space 16 to smoothly adjust and guide the air that has passed through the heat exchangers 4 toward the opening 13.

In the duct-type indoor unit 1 of this embodiment, the second part 19 of the partition member 3 that divides the second space 12 housing the centrifugal fan 5 from the heat exchange chamber 15 in which the heat exchangers 4 are disposed includes the inclined part 19*b* inclined from the orientation of the rotating shaft 27 toward the opening 13 of the first part 18. Therefore, the air exiting the heat exchange chamber 15 flows along the inclined part 19*b* and is smoothly guided into the air communication space 16.

In the duct-type indoor unit 1 of this embodiment, the pair of heat exchangers 4 are arranged to separate from each other gradually in the up and down direction Z of the casing 2 so as to have a V-shaped cross section open toward the inlet 7 of the casing 2. With this configuration, heat exchangers 4 having a wider area can be housed in the first space 11 of the casing 2 as compared to an arrangement in which the heat exchangers 4 are aligned parallel to the plane where the inlet 7 is formed. Since the heat exchangers 4 are arranged to have a V-shaped cross section open toward the inlet 7, the air can be introduced through the entire inlet 7 into the first space 11. The air thus introduced from the inlet 7 into the first space 11 can then flow through the entire heat exchangers 4 evenly.

In the duct-type indoor unit 1 of this embodiment, the direction in which an edge 4*c* at the top of the V-shape formed by the heat exchangers 4 extends is parallel to the rotating shaft 27 of the impeller 21. This way, while allowing the heat exchangers 4 to have a large area, unevenness in the air flow passing through the heat exchangers 4 can be reduced.

In the duct-type indoor unit 1 of this embodiment, the rotating shaft 27 of the impeller 21 of the centrifugal fan 5 is parallel to the downstream side face 2*b* of the casing 2 in which the outlet duct connection part 10 is formed. With such a configuration, the outlet 9 of the casing 2 is located on the radially outer side of the impeller 21, so that the air expelled from the impeller 21 radially outwards can be blown out smoothly from the outlet 9. Therefore, the flow resistance can be kept low as air flows unidirectionally toward the outlet duct DC2 without providing a guide plate or the like for guiding the air from the impeller 21 toward the outlet 9.

Figure 7:
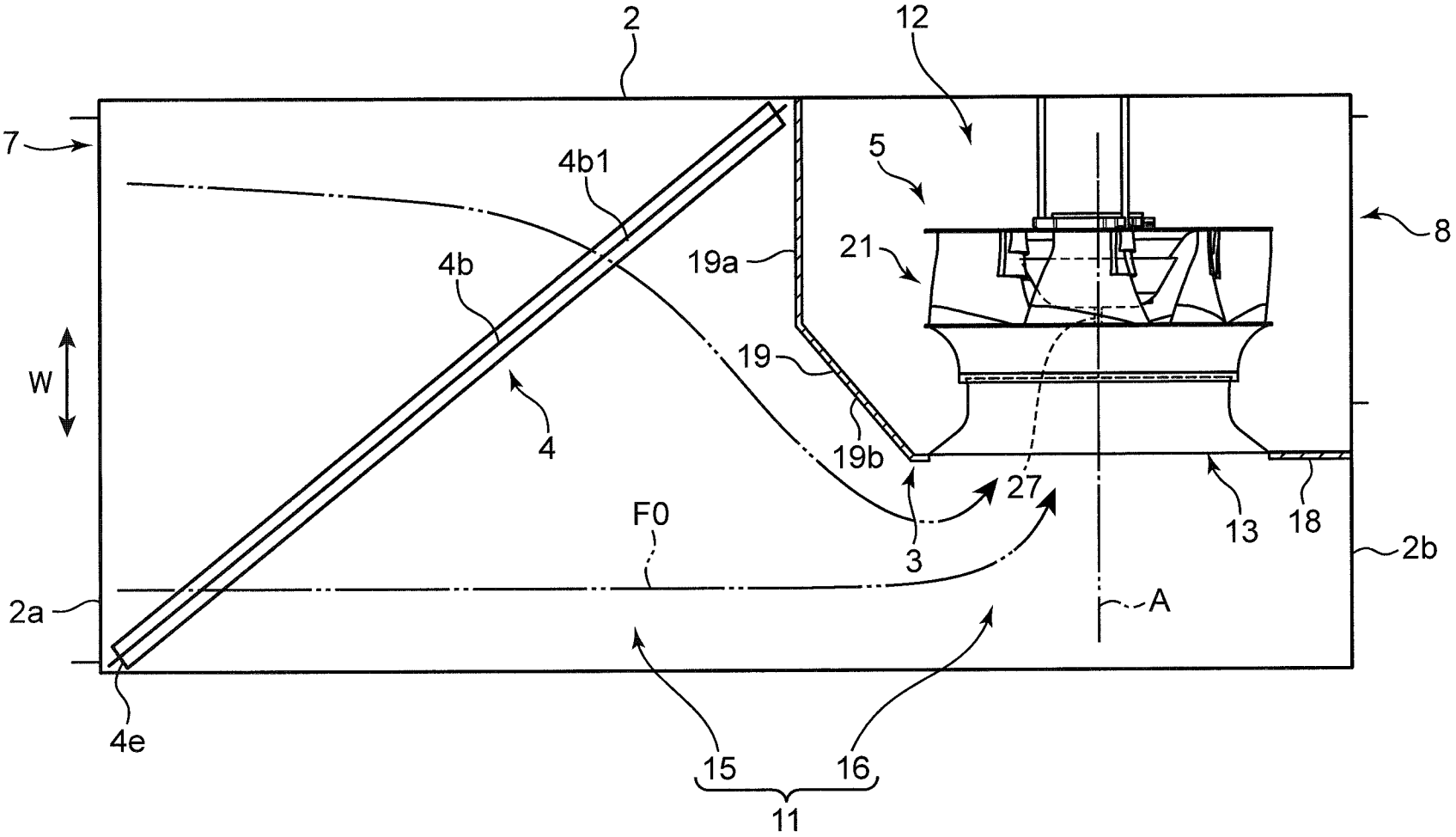
FIG. 7 is an internal configuration diagram of a duct-type indoor unit of an air conditioner according to a variation example of the present invention.

While two heat exchangers 4 arranged to have an open V-shaped cross section are shown in the embodiment as one example, the present invention is not limited to this arrangement, and may employ heat exchangers of various shapes and arrangements. For example, as one variation example of the present invention, as shown in FIG. 7, one large heat exchanger 4 may be arranged inside the heat exchange chamber 15 such that it is inclined and displaced from the rotating shaft 27 side toward the opening 13 side in the width direction W of the casing 2 as it approaches the inlet 7 of the casing 2. In this heat exchanger 4, the straight tubes 4*b*1 of the respective heat conducting tubes 4*b* are aligned parallel to each other along a direction vertical to the paper plane of FIG. 7. Each straight tube 4*b*1 extends along a plane parallel to the plane containing the rotating shaft 27. The upstream edge 4*e* of the heat exchanger 4 extends along the edge of the inlet 7 of the casing 2. In the arrangement like this, where the heat exchanger 4 is provided, as well, too, the air introduced from the inlet 7 into the casing 2 can contact the straight tubes 4*b*1 of all the heat conducting tubes 4*b* as it flows through the heat exchanger 4, so that the plurality of heat conducting tubes 4*b* can be reliably cooled by air. Accordingly, there is hardly any difference in the cooling performance of the refrigerant between the different flow paths.

The specific embodiments described above are summarized below.

The duct-type indoor unit of this embodiment includes: a casing including a first surface and a second surface opposing each other, an inlet duct connection part which is formed in the first surface and defines outer edges of an inlet and to which an inlet duct is connected, and an outlet duct connection part which is formed in the second surface and defines outer edges of an outlet, and to which an outlet duct is connected; a partition member partitioning interior of the casing into a first space on an inlet side and a second space on an outlet side, the partitioning member having an opening that communicates the first space with the second space; a heat exchanger arranged inside the first space; and a centrifugal fan having an impeller with a plurality of backward curved blades, the impeller being positioned inside the second space to suck in air in the first space through the opening, wherein the impeller has a rotating shaft parallel to the first surface.

With this configuration, due to the use of the centrifugal fan, the fan casing is no longer necessary, as a result of which the number of components can be reduced. Since the fan efficiency is improved as compared to the sirocco fan, the operating power of the fan can be reduced while a necessary level of static pressure and flow amount are secured.

The inlet duct connection part and the outlet duct connection part are arranged in the first surface and the second surface opposite each other of the casing, so that the inlet duct and the outlet duct can be arranged linearly.

Since the rotating shaft of the impeller is parallel to the first surface in which the inlet duct connection part is formed, it is easy to form a flow passage for air sucked in from the inlet formed in the first surface to flow toward the opening.

Preferably, the heat exchanger includes a plurality of heat conducting tubes that include a plurality of linearly extending straight tubes and end connection parts that communicate the ends of the straight tubes, the straight tubes extending along a plane parallel to a plane containing the rotating shaft.

With this configuration, the straight tubes of the heat conducting tubes in the heat exchanger extend along a plane parallel to the plane containing the rotating shaft, so that the air introduced into the casing from the inlet formed in the surface parallel to the rotating shaft can contact the straight tubes of all the heat conducting tubes as it flows through the heat exchanger, and can reliably cool the plurality of heat conducting tubes. Therefore, even if the refrigerant flows through different paths in the plurality of heat conducting tubes, there is hardly any difference in the cooling performance of the refrigerant between the different flow paths. Put differently, depending on the arrangement of the partition member (for example, if the partition member includes a first part extending orthogonally to the rotating shaft and formed with an opening), there may be an uneven distribution of the flow velocity of the air flow passing through the heat exchanger. Even so, if the straight tubes of the heat conducting tubes are positioned parallel to the rotating shaft, all the flow paths pass through (cover) the highest velocity range of the flow velocity distribution. Accordingly, there is hardly any difference in the cooling performance of the refrigerant between the different flow paths.

Preferably, the partition member includes a first part extending orthogonally to the rotating shaft and formed with the opening, while the casing further includes a third surface opposite the first part, and an air communication space is formed between the first part and the third surface for guiding air that has passed through the heat exchanger toward the opening.

With such a configuration, the air communication space is formed between the first part of the partition member extending in a direction orthogonal to the rotating shaft and the third surface of the casing opposite the first part. Therefore, the air communication space can be formed as a large space. This in turn allows the air communication space to smoothly adjust and guide the air that has passed through the heat exchanger toward the opening.

Preferably, the partition member further includes a second part continuous with the first part and dividing the second space from a place in the first space in which the heat exchanger is located, and the second part includes an inclined part inclined from an orientation of the rotating shaft toward the opening in the first part.

With such a configuration, the second part of the partition member that is a partition member dividing the second space housing the centrifugal fan from a place in the first space where the heat exchanger is located includes the inclined part inclined from the orientation of the rotating shaft toward the opening of the first part. Therefore, the air exiting the heat exchange chamber flows along the inclined part and is smoothly guided into the air communication space.

Preferably, there should be two heat exchangers arranged to separate from each other gradually toward the inlet of the casing so as to have an open V-shaped cross section.

With such a configuration, the heat exchangers having a wider area can be housed in the first space of the casing as compared to an arrangement in which the heat exchangers are aligned parallel to the plane where the inlet is formed. Since the heat exchangers are arranged to have a V-shaped cross section open toward the inlet, the air can be introduced through the entire inlet into the first space. The air thus introduced from the inlet into the first space can then flow through the entire heat exchangers evenly.

The direction in which an edge forming a top of the V-shape formed by the heat exchangers extends should preferably be parallel to the rotating shaft.

With this configuration, while allowing the heat exchangers to have a large area, unevenness in the air flow passing through the heat exchanger can be reduced.

The rotating shaft of the impeller should preferably be parallel to the second surface.

With such a configuration, the outlet of the casing is located on the radially outer side of the impeller, so that the air expelled from the impeller radially outwards can be blown out smoothly from the outlet. Therefore, the flow resistance can be kept low as air flows unidirectionally toward the outlet duct without providing a guide plate or the like for guiding the air from the impeller toward the outlet.

As described above, with the duct-type indoor unit of this embodiment, the number of components can be reduced, as well as the fan efficiency is improved so that the operating power for the fan can be reduced.

This application is based on Japanese Patent application No. 2013-188453 filed in Japan Patent Office on Sep. 11, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A duct-type indoor unit of an air conditioner, comprising:

a casing including a front plate in which an inlet duct connection part is formed and defines outer edges of an inlet and to which an inlet duct is connected, a rear plate in which an outlet duct connection part is formed and defines outer edges of an outlet and to which an outlet duct is connected, an upper plate, a lower plate, a first side plate, and a second side plate, the front plate and the rear plate being spaced apart from each other in a longitudinal direction of the casing, the upper plate and the lower plate being spaced apart from each other in a first direction which is orthogonal to the longitudinal direction of the casing, the first side plate and the second side plate being spaced apart from each other in a second direction orthogonal to the longitudinal direction and the first direction of the casing, the upper plate, the lower plate, the first side plate and the second side plate being connected with the front plate and the rear plate;

a partition member partitioning interior of the casing into a first space on an inlet side and a second space on an outlet side, the partitioning member having a first part extending in a direction orthogonal to the front plate and including an opening that communicates the first space with the second space, a second part that extends in a direction parallel to the front plate, and an inclined part connecting the first and second parts, the first, second; and inclined parts being continuous;

a heat exchanger arranged inside the first space; and a centrifugal fan having an impeller with a plurality of backward curved blades, the impeller being positioned inside the second space to suck in air in the first space through the opening, wherein the impeller as a rotating shaft parallel to the front plate, the inclined part of the partition member inclines with respect to the direction parallel to the front plate from the second part to the first part, the partition member is connected to the first side plate and the rear plate, the partition member, the upper plate, the lower plate and the first side plate function as a fan casing of the centrifugal fan, the heat exchanger is constituted by a first heat exchanger unit and a second heat exchanger unit, the first heat exchanger unit and the second heat exchanger unit being arranged to separate from each other gradually toward the inlet of the casing so as to have an open V-shaped cross section, the first heat exchanger unit is along a first imaginary plane, the second heat exchanger unit is along a second imaginary plane intersecting the first imaginary plane, and an imaginary intersection line by the first imaginary plane and second imaginary plane extends parallel to the rotating shaft.

2. The duct-type indoor unit of an air conditioner according to claim 1, wherein the rotating shaft of the impeller is parallel to the rear plate.

3. The duct-type indoor unit of an air conditioner according to claim 1, wherein an edge forming a top of the V-shape formed by the two units of the heat exchanger extends parallel to the rotating shaft.

4. The duct-type indoor unit of an air conditioner according to claim 1, wherein the second side plate is opposite the first part, and an air communication space is formed between the first part and the second side plate to guide air that has passed through the heat exchanger toward the opening.

5. The duct-type indoor unit of an air conditioner according to claim 4, wherein the rotating shaft of the impeller is parallel to the rear plate.

6. The duct-type indoor unit of an air conditioner according to claim 1, wherein the heat exchanger includes a plurality of heat conducting tubes, the heat conducting tubes include a plurality of linearly extending straight tubes, and end connection parts for connecting ends of the straight tubes, and the straight tubes extend along a plane parallel to a plane containing the rotating shaft.

7. The duct-type indoor unit of an air conditioner according to claim 6, wherein the second side plate is opposite the first part, and an air communication space is formed between the first part and the second side plate to guide air that has passed through the heat exchanger toward the opening.

* * * * *